US006609647B1

(12) United States Patent
Lai

(10) Patent No.: US 6,609,647 B1
(45) Date of Patent: Aug. 26, 2003

(54) STAPLE POSITIONING DEVICE FOR STAPLING GUN

(75) Inventor: Ming-Da Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/294,348

(22) Filed: Nov. 14, 2002

(51) Int. Cl.[7] ..... B27F 7/13
(52) U.S. Cl. ..... 227/120; 227/109; 227/128
(58) Field of Search ..... 227/120, 123, 227/127, 128, 109, 135

(56) References Cited

U.S. PATENT DOCUMENTS 3,037,207 A * 6/1962 D'Haem et al. ..... 227/109
3,041,614 A * 7/1962 Pazan ..... 227/123
4,043,504 A * 8/1977 Hueil et al. ..... 227/116
4,113,164 A * 9/1978 Muthenthaller ..... 227/124
4,304,349 A * 12/1981 Novak et al. ..... 227/109
4,688,710 A * 8/1987 Massari et al. ..... 227/109
5,433,367 A * 7/1995 Liu ..... 227/120
5,522,533 A * 6/1996 Mukoyama et al. ..... 227/109
5,632,431 A * 5/1997 Lin ..... 227/109
5,704,532 A * 1/1998 Wey ..... 227/109
5,743,453 A * 4/1998 Chuang ..... 227/109
5,934,539 A * 8/1999 Lee ..... 227/109
6,036,072 A * 3/2000 Lee ..... 227/120

* cited by examiner

*Primary Examiner*—Scott A. Smith
*Assistant Examiner*—Nathaniel Chukwurah
(74) *Attorney, Agent, or Firm*—Charles E. Baxley

(57) ABSTRACT

A staple positioning device in a magazine assembly of stapling gun includes a positioning plate movably received in the magazine and having two inclined slots. A driving plate has two bosses which are movably engaged with the two inclined slots and an end of the driving plate is connected to a pushing member on an outside of the magazine assembly. A shuttle is movably connected to the magazine assembly and a first end member of the shuttle moves the pushing member when moving the shuttle. The vertical movement of the driving plate makes the positioning plate to move in a horizontal direction so as to urge staples with different sizes in the magazine assembly.

2 Claims, 5 Drawing Sheets

STAPLE POSITIONING DEVICE FOR STAPLING GUN

FIELD OF THE INVENTION

The present invention relates to a staple position device for a stapling gun and the device includes a positioning plate which is movable in the magazine to position the staples with different sizes.

BACKGROUND OF THE INVENTION

A conventional stapling gun includes a barrel with a head portion on a front end of the barrel and an opening is defined through the head portion. A handle and a magazine are respectively connected to the barrel wherein the handle is connected to a pressurized air source and the magazine stores piles of staples therein. The staples are fed into the head portion and one staple is ejected from the opening at a time when squeezing the trigger. In order to use different sizes of staples in the stapling gun, a staple positioning device is installed in the magazine so as to position the staples with different widths. A plurality of small parts are installed in the limited space in the magazine and each part includes holes or slots. This makes the manufacturing cost high and the maintenance is difficult. In order to ensure the parts durable, special and expensive material is used. Besides, all the small parts are disposed in the magazine so that the whole magazine has to be disassembled when the small parts are to be maintained.

SUMMARY OF THE INVENTION

In accordance with one aspect of the present invention, there is provided a magazine assembly for a stapling gun wherein the magazine assembly has a groove defined longitudinally in an inside thereof and an elongated hole is defined through the magazine assembly and communicates with the groove. A positioning plate is movably received in the magazine assembly and two inclined slots are defined through the positioning plate, A driving plate is movably received in the groove and has two bosses movably engaged with the two inclined slots in the positioning plate. A tongue extends from a lower end of the driving plate and is connected to a pushing member via the elongated hole.

A cap is connected to an outside of the magazine assembly and a gap is defined between the cap and the magazine assembly. A chamber is defined in the cap so as to receive the pushing member. An aperture is defined through a lower end of the cap and communicates with the chamber.

A retaining hole is defined in a lower end of the pushing member and is located in alignment with the aperture. A rod has a flange extending radially outward therefrom and a spring is mounted on a first end of the rod. The first end of the rod is movably inserted in the aperture and an end of the spring is secured in the retaining hole. The other end of the spring contacts the flange.

A shuttle is movably connected to the two sidewalls and a first end member and a second end member respectively extend laterally from two ends of the shuttle. The first end member is movably inserted in the gap and pushing the pushing member to press the spring.

The primary object of the present invention is to provide a magazine assembly of a stapling gun wherein only the positioning plate is located between two sidewalls of the magazine assembly so that it is easy to maintain the magazine assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
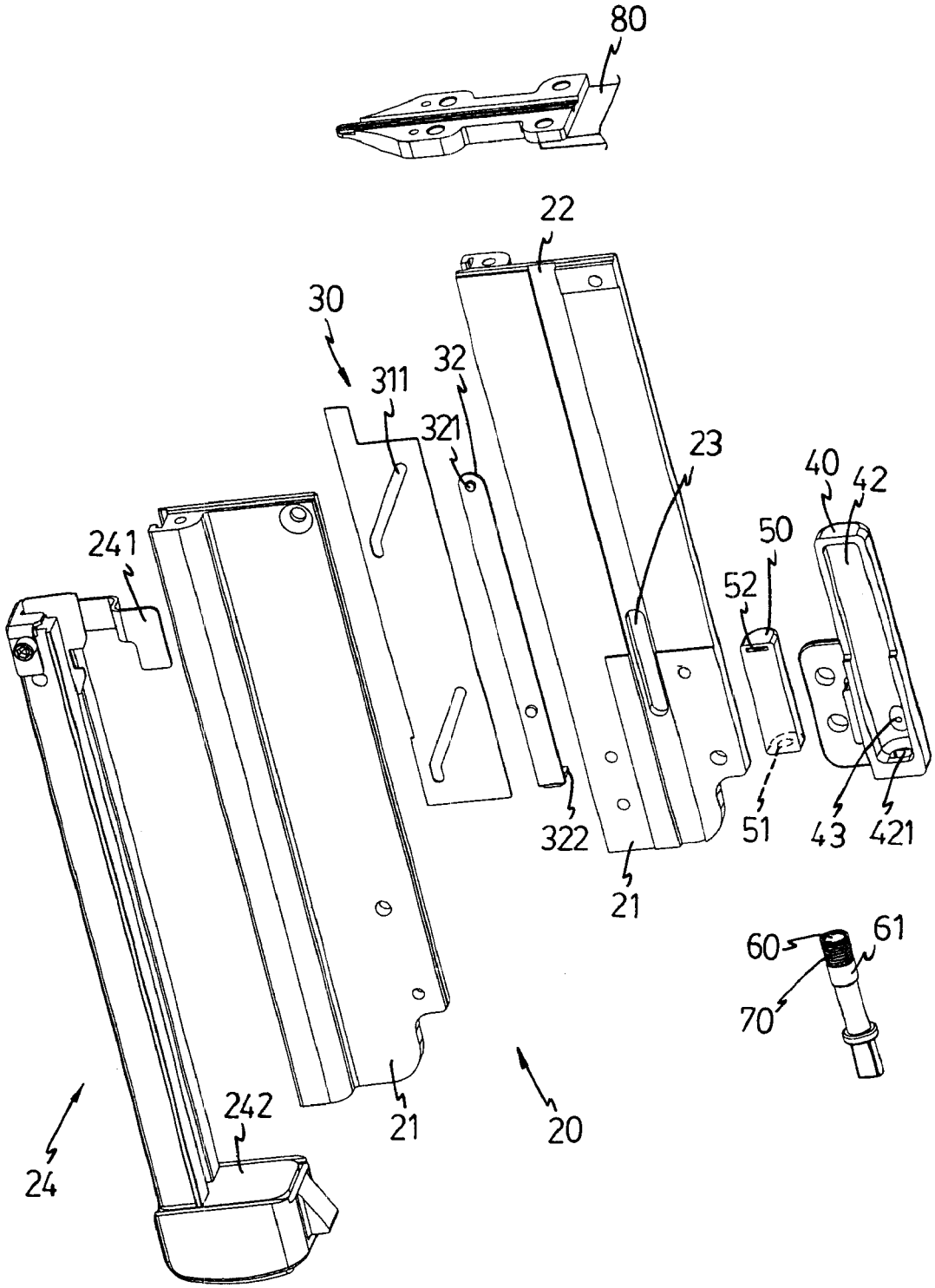
FIG. 1 is an exploded view to show the magazine assembly of the present invention.
Figure 2:
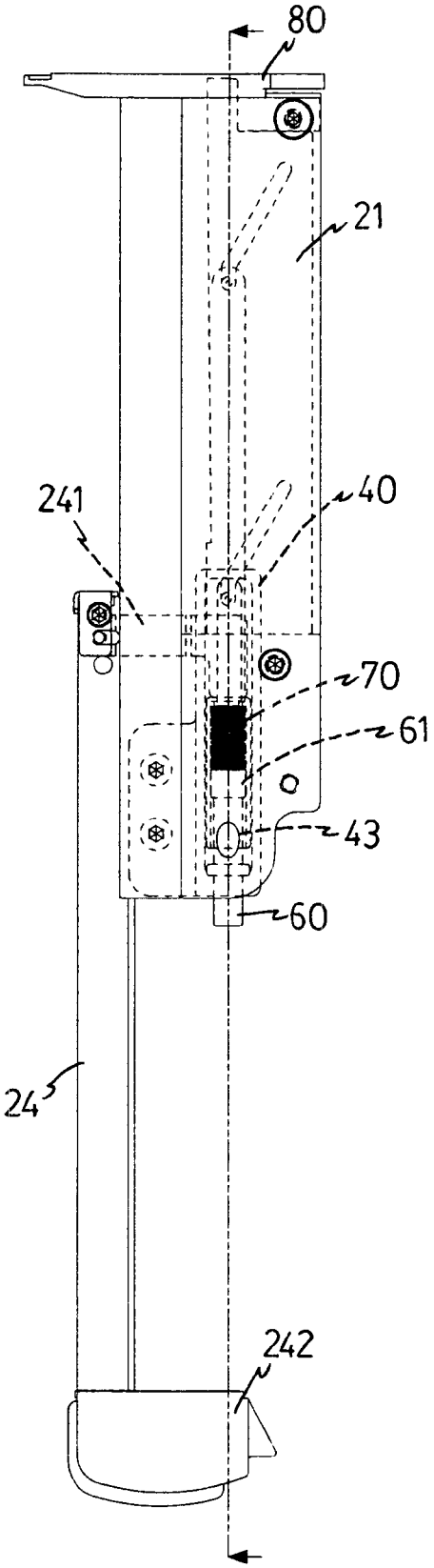
FIG. 2 is a side view to show that the shuttle of the magazine assembly of the present invention is pulled down.
Figure 3:
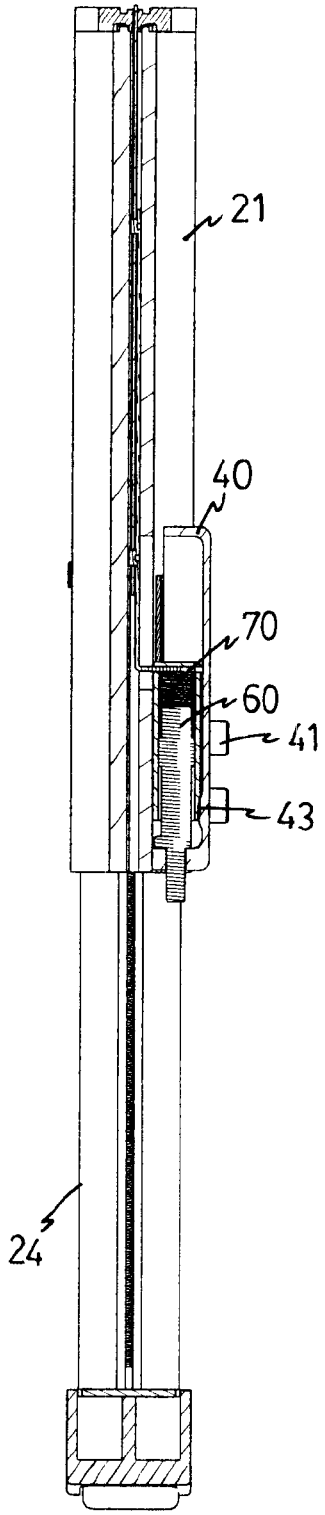
FIG. 3 is another side view to show that the shuttle of the magazine assembly of the present invention is pulled down.

Referring to FIGS. 1 to 3, the magazine assembly 20 for stapling guns of the present invention comprises two sidewalls 21 and a groove 22 defined in an inside of one of the two sidewalls 21. An elongated hole 23 is defined through the sidewall 21 and communicating with the groove 22. A shuttle 24 is movably connected to the two sidewalls 21 and a first end member 241 and a second end member 242 respectively extend laterally from two ends of the shuttle 24. The magazine assembly 20 is connected to a head portion 80 of the stapling gun.

A positioning plate 30 is movably received between the two sidewalls 21 and two inclined slots 311 are defined through the positioning plate 30. A driving plate 32 is movably received in the groove 22 and has two bosses 321 extending therefrom. The two bosses 321 are movably engaged with the two inclined slots 311 in the positioning plate 30. A tongue 322 extends from a lower end of the driving plate 32 and extends through the elongated hole 23. A pile of staples (not shown) will be received between the two sidewalls 21 and urged by a side of the positioning plate 30.

A cap 40 is connected to an outside of the sidewall 21 and a gap 422 is defined between the cap 40 and the sidewall 21. A chamber 42 is defined in the cap 40 and an aperture 421 is defined through a lower end of the cap 40 and communicates with the chamber 42.

A pushing member 50 is movably received in the chamber 42 of the cap 40 and an end of the pushing member 50 has a slit 52 in which the tongue 322 of the driving plate 32 is inserted. The other end of the pushing member 50 has a retaining hole 51 defined therethrough which is located in alignment with the aperture 421. A rod 60 has a flange 61 extending radially outward therefrom and a spring 70 is mounted on a first end of the rod 60 and an end of the spring 70 contacts the flange 61. The first end of the rod 60 movably inserted in the aperture 421 and an end of the spring 70 is secured in the retaining hole 51. A protrusion 43 extends from an inside of the cap 42.

Figure 4:
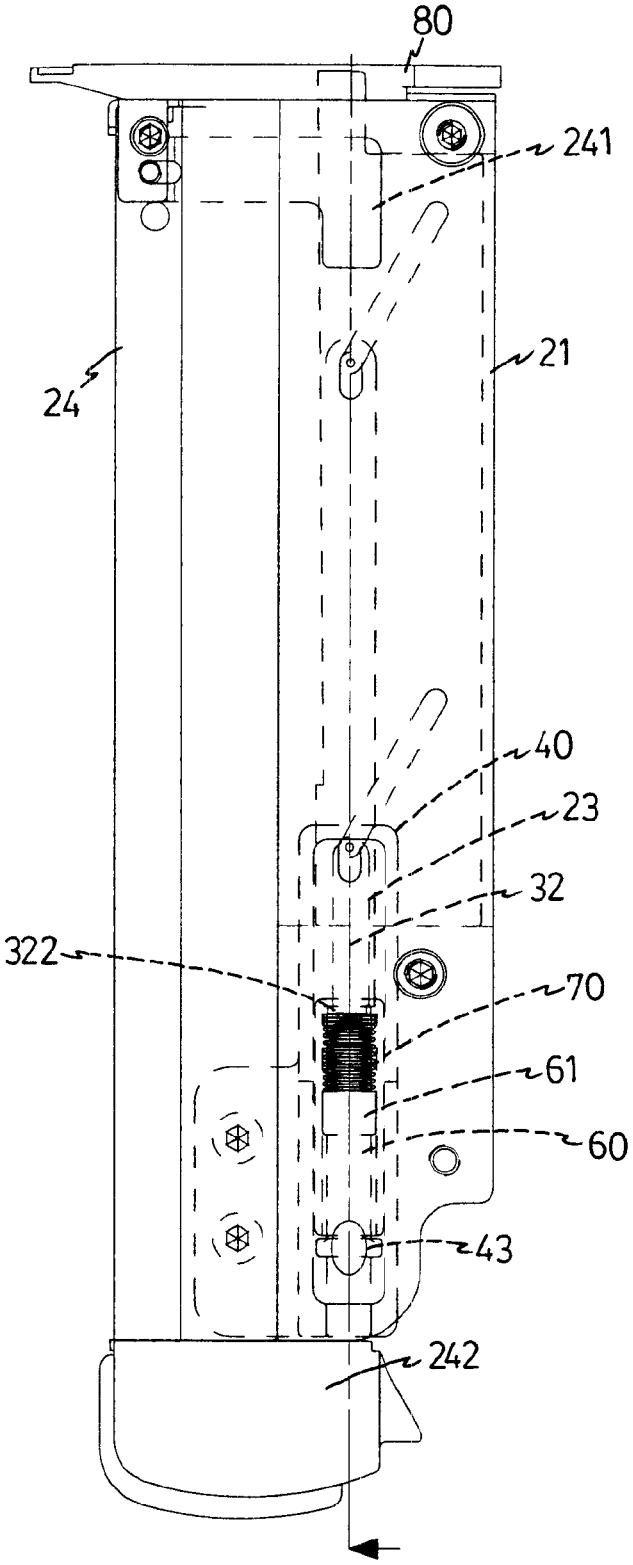
FIG. 4 shows that the shuttle of the magazine assembly of the present invention is pushed back to its original position.
Figure 5:
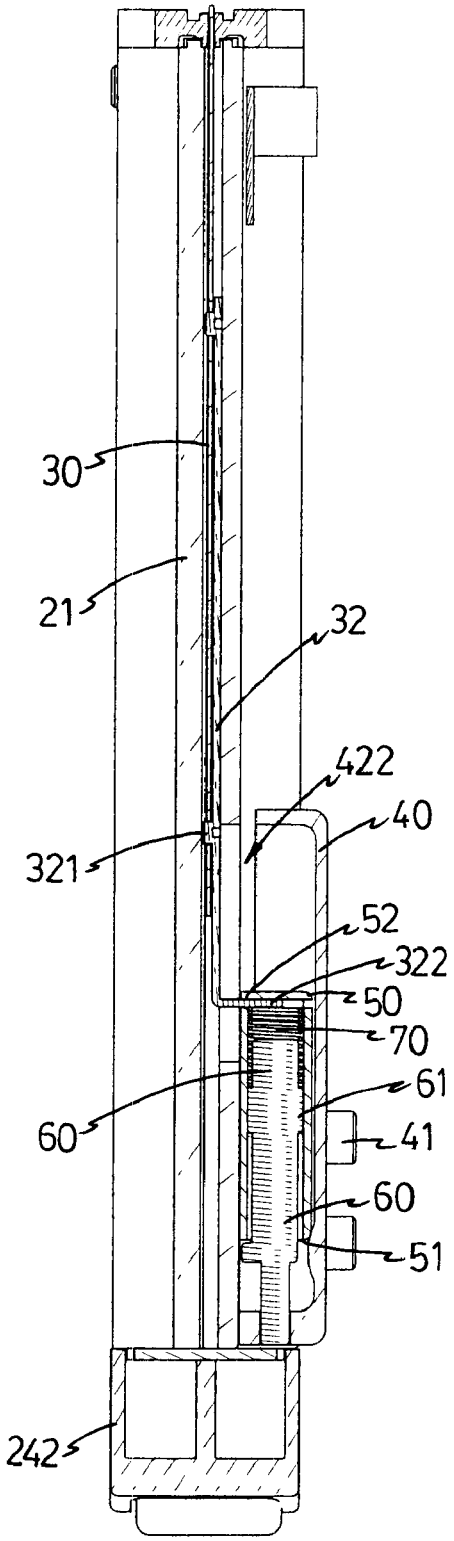
FIG. 5 shows that the pushing member pushes the positioning plate is moved when the shuttle of the magazine assembly of the present invention is pushed back to its original position.

When installing the staples (not shown) in the magazine assembly 20, the shuttle 24 is pulled down and the first end member 241 is movably inserted in the gap 422 and pushes the pushing member 50 to press the spring 70. The protrusion 43 is a soft and frictional member and can be deformed when the outer surface of the pushing member 50 is moved over the protrusion 43 and urged by the protrusion 43. When the pushing member 50 moves downward, the driving plate 32 is moved together with the pushing member 50 and the bosses 321 move the positioning plate 30 horizontally to empty a space for the staples. After the staples are installed, as shown in FIGS. 4 and 5, the shuttle 24 is pushed upward and the lower end of the rod 60 extending from the aperture 421 is pushed by the second end member 242 and the pushing member 50 is bounced upward by the spring 70 to push the driving plate 32 which provide a force to the positioning plate 30 to urge and position the staples.

It is to be noted that the cap 40, the pushing member 50 and the shuttle 24 are accessible from outside of the magazine assembly 20 so that they can be made by plastic material and are easily to be maintained.

While we have shown and described the embodiment in accordance with the present invention, it should be clear to those skilled in the art that further embodiments may be made without departing from the scope of the present invention.

What is claimed is:

1. A magazine assembly for stapling guns, comprising:

two sidewalls and a groove defined longitudinally in an inside of one of said two sidewalls, an elongated hole defined through said sidewall and communicating with said groove;

a positioning plate movably received between said two sidewalls and two inclined slots defined through said positioning plate, a driving plate movably received in said groove and having two bosses extending therefrom, said two bosses movably engaged with said two inclined slots in said positioning plate, a tongue extending from a lower end of said driving plate and extending through said elongated hole;

a cap connected to an outside of said sidewall and a gap defined between said cap and said sidewall, a chamber defined in said cap and an aperture defined through a lower end of said cap and communicating with said chamber;

a pushing member movably received in said chamber of said cap and an end of said pushing member connected to said tongue of said driving plate, the other end of said pushing member having a retaining hole defined therethrough which is located in alignment with said aperture, a rod having a flange extending radially outward therefrom and a spring mounted on a first end of said rod, said first end of said rod movably inserted in said aperture and an end of said spring secured in said retaining hole and the other end of said spring contacting said flange, and a shuttle movably connected to said two sidewalls and a first end member and a second end member respectively extending laterally from two ends of said shuttle, said first end member movably inserted in said gap and pushing said pushing member to press said spring.

2. The magazine assembly as claimed in claim 1 further comprising a protrusion extends from an inside of said cap and urging an outer surface of said pushing member when said pushing member is moved downward.

* * * * *